US005188328A

United States Patent [19]

Thompson

[11] Patent Number: 5,188,328

[45] Date of Patent: Feb. 23, 1993

[54] UNDERCOUNTER REVOLVER SUPPORT

[76] Inventor: Thomas O. Thompson, 75 H. C. Walton Dr., Jackson, Tenn. 38301

[21] Appl. No.: 819,820

[22] Filed: Jan. 13, 1992

[51] Int. Cl.[5] ..... A47F 7/00

[52] U.S. Cl. ..... 248/309.2; 211/64; 224/912; 248/207

[58] Field of Search ..... 248/309.2, 207; 211/64, 211/168, 96; 224/911, 912

[56] References Cited

U.S. PATENT DOCUMENTS

| | | | |
|---|---|---|---|
| 945,520 | 1/1910 | Greenwood | 211/64 |
| 1,427,065 | 8/1922 | Cervenka . | |
| 1,579,552 | 4/1926 | Ludlow . | |
| 2,401,174 | 5/1946 | McAuley | 224/912 X |
| 2,764,326 | 9/1956 | Stanton | 224/912 X |
| 3,031,787 | 5/1962 | Womble, Jr. . | |
| 3,635,352 | 1/1972 | Brooks et al. | 211/168 X |
| 4,309,065 | 1/1982 | Pappas | 224/912 X |
| 4,461,442 | 7/1984 | Keenan . | |
| 4,483,501 | 11/1984 | Eddy . | |
| 4,570,890 | 2/1986 | Lohn | 248/309.2 |

FOREIGN PATENT DOCUMENTS

| | | | |
|---|---|---|---|
| 2253203 | 5/1974 | Fed. Rep. of Germany | 211/168 |

*Primary Examiner*—David L. Talbott

*Attorney, Agent, or Firm*—Jacobson, Price, Holman & Stern

[57] ABSTRACT

A bracket is provided for alternate mounting from downwardly facing horizontal surface or a vertical surface and the brackets rotatably supports a sleeve therefrom (in any one of four different elevated positions relative to the bracket), with the sleeve being inclined and supporting a horizontal support rod therefrom of a diameter end length to have the barrel of a revolver telescoped thereover with the free end of the support rod extending through the revolver barrel and at least substantially the full length of one of the cartridge chambers in the associated revolver cylinder.

11 Claims, 1 Drawing Sheet

UNDERCOUNTER REVOLVER SUPPORT

BACKGROUND OF THE INVENTION

1. Field of the Invention

This invention relates to a mount designed to be supported beneath a counter or similar structure and to support a revolver therefrom in position ready for rapid usage in the event it suddenly becomes necessary for the revolver to be used.

2. Description of Related Art

Various different forms of supports including some of the general structural and operational features of the instant invention heretofore have been provided such as those disclosed in U.S. Pat. Nos.: 1,427,065, 1,579,552, 3,031,787, 4,461,442 and 4,483,501. However, these previously known forms of supports do not include the overall combination of structural and operational features of the instant invention whereby a revolver may be supported in predetermined ready position at a plurality of heights and in a manner such that the supported revolver, if accidentally brushed against, may swing to an out of the way position and then immediately return, by gravity, to the predetermined ready position thereof.

SUMMARY OF THE INVENTION

The revolver support of the instant invention includes a bracket component designed to be supported either from the underside of a horizontal support or from a vertical support surface. In addition, the support includes a revolver barrel supporting portion thereof which may be mounted from the bracket in any one of four height adjusted positions relative to the bracket and which is mounted from the bracket in position for support of the associated revolver in a horizontal position therefrom. Further, the barrel supporting portion is mounted from the bracket for angular displacement relative thereto in a manner such that if the supported revolver is brushed against it may swing to an out of the way position. Finally, the barrel supporting portion is pivotally supported from the bracket in a manner such that the weight of the revolver supported therefrom will automatically swing the revolver back to a predetermined position after having been brushed aside.

The main object of this invention is to provide a support for a revolver which may used in many environments for the purpose of supporting a revolver in a readiness for use thereof at a moments notice.

Another object of this invention is to provide a revolver support including a stationery bracket portion and a revolver barrel supporting portion mounted from the bracket in any one of four vertically adjusted positions relative to the bracket.

Still another important object of this invention is to provide an undercounter support in accordance with the preceding objects and having a mounting bracket portion specifically adapted to be mounted from the under surface of a horizontal support or from a vertical support surface.

A further object of this invention is to provide a revolver support which also may be used to support a semi-automatic pistol.

A final object of this invention to be specifically enumerated herein is to provide a revolver support in accordance with the preceding objects and which will conform to conventional forms of manufacture, be of simple construction and easy to use so as to provide a device that will be economically feasible, longlasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
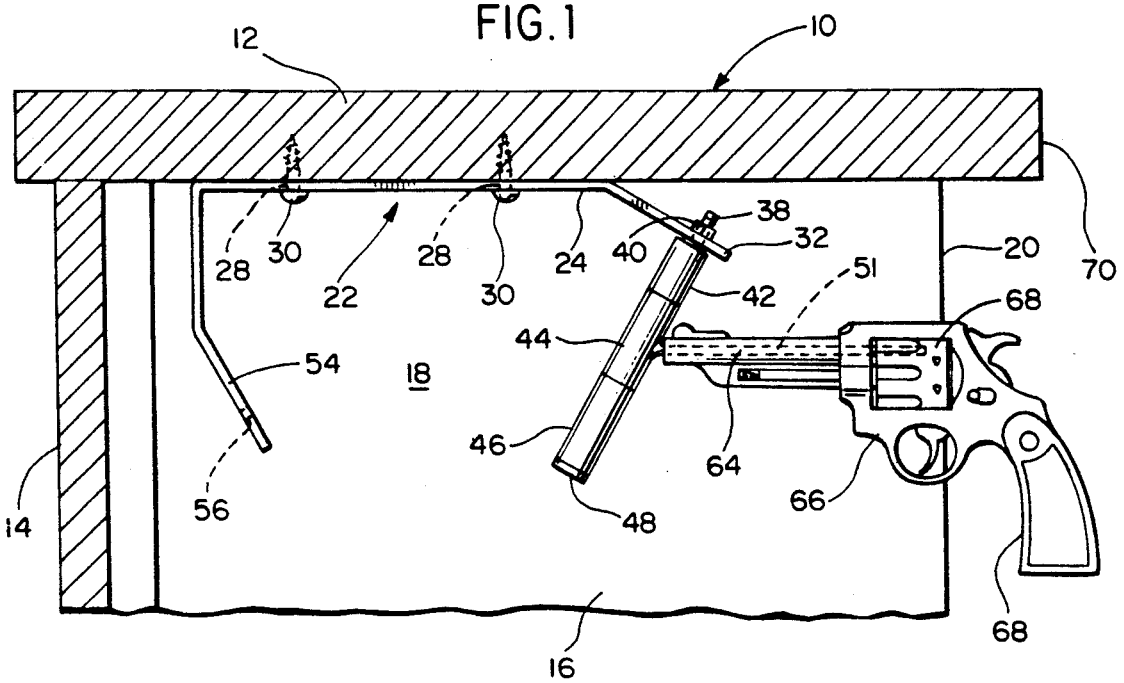
FIG. 1 is a vertical sectional view of a typical counter construction with the undercounter revolver support of the instant invention mounted from the underside of the horizontal counter top and with the revolver supported therefrom illustrated in an intermediate height position relative to the mounting bracket.
Figure 2:
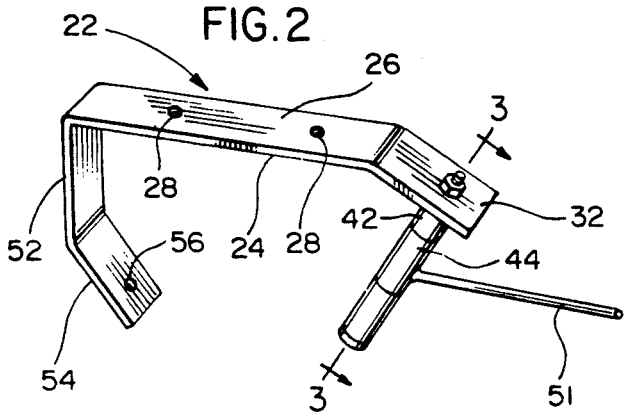
FIG. 2 is a perspective view of the revolver support on somewhat of a reduced scale.
Figure 3:
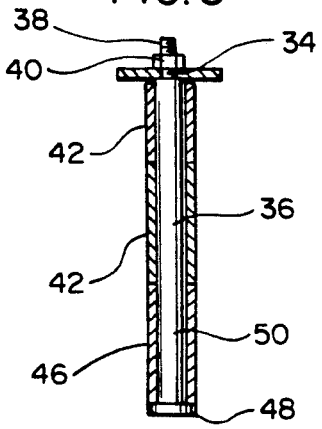
FIG. 3 is an enlarged fragmentary sectional view taken substantially upon the plane indicated by the section 3—3 of FIG. 2.

Referring now more specifically to FIG. 1 the reference numeral 10 generally designates a counter including a top panel 12, a front panel 14 and an end panel 16, the area 18 beneath the top panel 12 and rearward of the front panel 14 being open at its rear as at 20. The counter 10 may be located in a convenience store, a liquor store, a savings and loan office or any other location which may be subject to a robbery.

The undercounter revolver support of the instant invention is referred to in general by the reference numeral 22 and is illustrated in FIG. 1 as mounted from the underside of the top panel 12.

The support 22 includes a bracket 24 defining an elongated mounting strap portion or flange 26 apertured as at 28 for receiving mounting screws 30 therethrough.

One end of the mounting strap portion 26 includes a first mounting flange portion 32 which is angulated 30 degrees relative to the mounting strap portion 26 and has a central aperture 34 formed therethrough. A headed shoulder bolt or pivot shaft 36 includes a reduced diameter threaded shank portion 38 on one end secured upwardly through the aperture 34 by a threaded nut 40 and a plurality of sleeves 42, 44 and 46 are mounted upon the shoulder portion 50 of the bolt 36 between the mounting flange portion 32 and the head 48 of the bolt 36. The shoulder portion 50 of the bolt 36 is four inches long and the sleeves 44 and 46 each are one and seven sixteenths inches long while the sleeve 42 is fifthteen sixteenths inches long. In addition, the sleeve 44 includes a laterally outwardly inclined support rod 51 supported therefrom which is inclined relative to a transverse diametric plane of the sleeve 44 an amount substantially equal to the inclination of the mounting flange portion 32 relative to the mounting strap portion 26 of the bracket 24.

The end of the mounting strap 26 remote from the mounting flange portion 32 terminates in a right angle portion 52 and the latter, in turn, terminates in a second mounting flange portion 54 provided with a central aperture 56 and inclined relative to the portion 52 substantially the same amount the mounting flange portion 32 is inclined relative to the mounting strap portion 26. As may be seen from FIG. 1, the fasteners or screws 30 may be used to mount the bracket 24 from the underside of a horizontal member and from FIG. 5 of the drawings it may be seen that the fasteners 30 also may be used to mount the bracket 24 from a vertical surface 60. When the bracket 24 is mounted from a horizontal under surface in the manner illustrated in FIG. 1, the first mounting flange portion 32 is inclined generally 30 degrees relative to the horizontal. However, when the mounting bracket 24 is mounted from the vertical surface 60 in the manner illustrated in FIG. 5, the second mounting flange portion 54 is inclined generally 30 degrees relative to the horizontal. In this instance, the shoulder bolt 36 and the sleeves 42, 44 and 46 are mounted from the second mounting flange portion 54.

The sleeves 42, 44 and 46 are free to rotate, independently, relative to the shoulder portion 50 of the shoulder bolt 36. Further, the length of the rod 51 may be substantially the same length as the barrel 64 of the revolver 66 illustrated in FIG. 1, plus substantially the full length of one of the cartridge chambers (not shown) in the cylinder 68 of the revolver 66, whereby when an empty chamber of the cylinder 68 is registered with the barrel 64 the barrel 64 may be telescoped fully over the rod 51 such that the free end of rod 51 projects into the cylinder 68. In this manner, the revolver 66 may not be fired, inasmuch as the cylinder 68 may not be rotated to a position with a cartridge containing chamber thereof registered with the barrel 64, until such time as the revolver 66 is removed from the rod 51.

Figure 4:
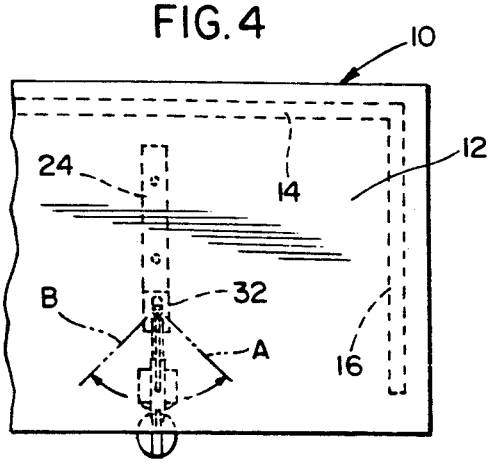
FIG. 4 is a fragmentary reduced top plan view of the structure illustrated in FIG. 1.

As illustrated in FIGS. 1 and 4, the hand grip 68 of the revolver 66 may project slightly behind the rear edge 70 of the top panel 12 in a manner maintaining the hand grip 68 immediately available to a person standing behind the counter 10 and wishing to remove the revolver 66 from the rod 51. However, should a person walking along behind the counter accidentally strike the hand grip 68, the revolver 66, rod 51 and sleeve 44 are free to rotate to positions with the center of the axis of the barrel 64 extending along path A or B illustrated in FIG. 4. Thereafter, inasmuch as the shoulder bolt 36 is inclined relative to the vertical, if the revolver 64 has been swung to a position coinciding with either path A or B, the force of gravity will cause the sleeve 44 to automatically swing back to the position thereof illustrated in FIG. 1.

Figure 5:
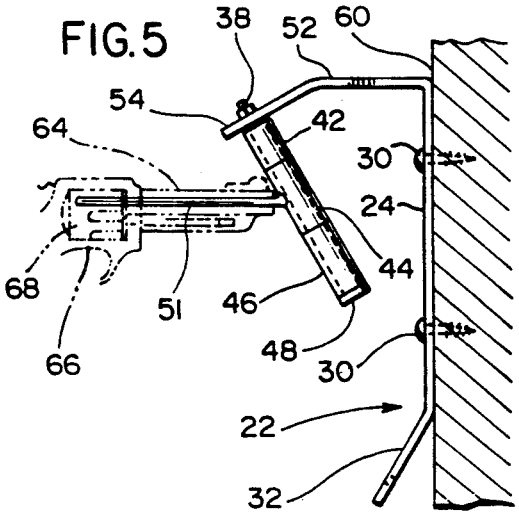
FIG. 5 is a fragmentary vertical sectional view of a vertical support member illustrating the manner in which the revolver support may be mounted from a vertical support surface.

If the sleeve 44 is disposed uppermost, the revolver 66 will be disposed at its uppermost possible position relative to the shoulder bolt 36. However, if the sleeve 44 is positioned as illustrated in FIGS. 1 and 5, the revolver 66 will be disposed in the second highest position relative to the shoulder bolt 36.

On the other hand, if the positions of the sleeves 42 and 46 are reversed, the revolver 66 will be disposed in its next to the lowest position relative to the shoulder bolt 50 and if the sleeve 44 is disposed lowermost, the revolver 66 will be disposed in its lowest position relative to the shoulder bolt 36. Therefore, the shoulder bolt 36 and the sleeves 42, 44 and 46 enable the revolver 66 to be supported in any of four different elevated positions relative to the shoulder bolt 36. In addition, the revolver 66 may be supported in a manner enabling it to be deflected to either of the center line positions A and B thereof illustrated in FIG. 4.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mount for a pistol of the type including a forwardly opening barrel, said mount including an elongated horizontal mounting portion for mounting parallel to a horizontal mounting surface, one end of said mounting portion including a depending, inclined pivot shaft downwardly tilted toward the other end of said mounting position, a horizontal support rod having a base end and a free end, mounting means mounting said support rod at its base end from said pivot shaft for free gravity angular displacement about said pivot shaft, said rod being disposed in generally horizontal position when in its gravity biased position, said rod being adapted to support a pistol therefrom with the barrel of said pistol loosely telescoped over the free end of said rod.

2. The mount of claim 1 wherein said mounting means includes a support sleeve journaled on said pivot shaft, said base end of said rod being anchored to said support sleeve.

3. The mount of claim 2 wherein said pivot shaft includes a lower end abutment, a plurality of sleeves removably, slidably and rotatably mounted on said shaft portion and interchangeable in position thereon, said support sleeve comprising one of said plurality of sleeves.

4. The mount of claim 3 wherein at least said support sleeve and one of the other plurality of sleeves are of different length.

5. The mount of claim 4 wherein said sleeves equal three number and the third sleeve is of a length equal to the length of said support sleeve.

6. A mount for a pistol of the type including a forwardly opening barrel, a support rod having a base end and a free end, mounting means mounting said support rod at its base end for free gravity angular displacement about an upstanding axis inclined relative to vertical with the upper portion of said axis inclined in the direction in which the free end projects when said rod is in its gravity biased position, said rod being disposed in generally horizontal position when in its biased position, said rod being adapted to support a pistol therefrom with the barrel of said pistol loosely telescoped over the free end of said rod, said mount including an elongated mounting strap portion adapted to be mounted parallel to and from the underside of a horizontal panel member or, alternately, parallel to and from a vertical surface, one end of said strap portion including a first mounting flange portion angulated generally 30 degrees relative to said mounting strap portion defining an included angle of generally 150 degrees with one side of strap member and the other end of said strap portion includes a second mounting flange portion inclined generally 120 degrees relative to said mounting strap portion defining an included angle of generally 60 degrees with said one side of said strap member, said upstanding axis being disposed generally normal to said first mounting flange portion when said mounting strap portion is generally horizontal and generally normal to said second mounting flange portion when said mounting strap portion is generally vertical.

7. The mount of claim 6 wherein said mounting means includes an inclined shaft portion having a center axis coinciding with said upstanding axis and a support sleeve journaled on said shaft portion, said base end of said rod being anchored to said support sleeve.

8. The mount of claim 7 wherein said shaft portion includes a lower end abutment, a plurality of sleeves removably, slidably and rotatably mounted on said shaft portion and interchangeable in position thereon, said support sleeve comprising one of said plurality of sleeves.

9. A support for a pistol, said support including an elongated, horizontal mounting strap adapted for mounting from a downwardly facing horizontal mounting surface, one end of said mounting strap including a first mounting flange portion downwardly angulated relative to said mounting strap and defining an included angle of generally 150 degrees with the under side of said mounting strap, a pivot shaft mounted from and disposed generally normal to said first mounting flange, a sleeve journaled on said pivot shaft, said sleeve including a horizontal support rod projecting outwardly therefrom and adapted to have a pistol barrel loosely telescoped thereover, said support rod defining an included angle of generally 60 degrees with the upper end of said sleeve.

10. The mount of claim 9 wherein the other end of said strap includes a second mounting flange portion angulated relative to said mounting strap and defining an included angle of generally 60 degrees relative said side, said pivot shaft being repositionable for support from said second mounting flange portion in position normal thereto and said mounting strap being mountable from a vertical surface with said second mounting flange portion inclined generally 30 degrees relative to the horizontal.

11. The mount of claim 1 including a revolver-type pistol incorporating a barrel and a rotatable cartridge cylinder having cartridge chambers spaced thereabout successively registerable with one end of said barrel, the other end of said barrel being loosely telescoped over said free end of said rod with said rod free end projecting into the cartridge chamber registered with said barrel.

* * * * *